US006829799B2

(12) United States Patent
Kuhn

(10) Patent No.: US 6,829,799 B2
(45) Date of Patent: Dec. 14, 2004

(54) ISCHIAL TUBEROSITY PRESSURE RELIEF CUSHION

(76) Inventor: Paul J. Kuhn, 1105 Rte. 27, Craryville, NY (US) 12521

( * ) Notice: Subject to any disclaimer, the term of this patent is extended or adjusted under 35 U.S.C. 154(b) by 59 days.

(21) Appl. No.: 10/408,087

(22) Filed: Apr. 4, 2003

(65) Prior Publication Data

US 2004/0194215 A1 Oct. 7, 2004

(51) Int. Cl.[7] ..... A47C 17/00

(52) U.S. Cl. ..... 5/730; 5/648; 5/652; 5/655.9; 5/736

(58) Field of Search ..... 5/730, 736, 652, 5/653, 655.9, 630, 648; 297/452.15, 452.27

(56) References Cited

U.S. PATENT DOCUMENTS

| | | | | |
|---|---|---|---|---|
| 2,082,151 A | | 6/1937 | De Poix | |
| 2,384,713 A | | 9/1945 | Varma | |
| 2,785,739 A | | 3/1957 | McGregor, Jr. et al. | |
| 3,016,317 A | | 1/1962 | Brunner | |
| 3,239,854 A | | 3/1966 | Freedlander | |
| 3,258,791 A | | 7/1966 | Kaplan | |
| 3,419,920 A | | 1/1969 | Maddux, Jr. et al. | |
| 3,512,190 A | | 5/1970 | Buff | |
| 3,604,025 A | | 9/1971 | Mims | |
| 3,626,526 A | | 12/1971 | Viel | |
| 3,679,263 A | | 7/1972 | Cadiou | |
| 3,828,378 A | | 8/1974 | Flam | |
| 4,042,987 A | | 8/1977 | Rogers | |
| 4,070,719 A | | 1/1978 | Morgan | |
| 4,073,020 A | | 2/1978 | Stalter et al. | |
| 4,092,751 A | | 6/1978 | Burkholder et al. | |
| 4,110,881 A | | 9/1978 | Thompson | |
| 4,265,484 A | | 5/1981 | Stalter | |
| 4,522,447 A | | 6/1985 | Snyder et al. | |
| 4,615,856 A | | 10/1986 | Silverman | |
| 4,673,212 A | | 6/1987 | Mayer | |
| 4,673,452 A | | 6/1987 | Awdhan | |
| 4,726,086 A | | 2/1988 | McEvoy | |
| 4,755,411 A | | 7/1988 | Wing et al. | |
| 4,804,221 A | | 2/1989 | Saiki | |
| 4,809,374 A | | 3/1989 | Saviez | |
| 4,862,538 A | * | 9/1989 | Spann et al. | 5/730 |
| 4,901,387 A | | 2/1990 | Luke | |
| 4,955,096 A | | 9/1990 | Gilroy et al. | |
| 5,025,519 A | | 6/1991 | Spann et al. | |
| 5,079,790 A | | 1/1992 | Pouch | |
| 5,101,527 A | * | 4/1992 | Wadsworth et al. | 5/727 |
| 5,160,785 A | | 11/1992 | Davidson, Jr. | |
| 5,178,811 A | | 1/1993 | Farley | |
| 5,317,773 A | | 6/1994 | Graebe | |
| 5,490,299 A | | 2/1996 | Dinsmoor, III et al. | |
| 5,568,660 A | | 10/1996 | Raburn et al. | |
| 5,658,050 A | | 8/1997 | Lorbiecki | |
| 5,677,036 A | * | 10/1997 | Kording | 428/156 |
| 5,720,518 A | * | 2/1998 | Harrison | 297/214 |
| 5,960,497 A | | 10/1999 | Castellino et al. | |
| 6,089,657 A | | 7/2000 | Banno et al. | |
| 6,256,819 B1 | * | 7/2001 | Maier et al. | 5/653 |
| 6,302,488 B1 | | 10/2001 | Tanigaki et al. | |
| 6,442,780 B1 | | 9/2002 | Phillips et al. | |

FOREIGN PATENT DOCUMENTS

| | | | | |
|---|---|---|---|---|
| DE | 199 42 435 A1 | | 3/2001 | |
| FR | 2646772 A1 | * | 11/1990 | A47C/21/08 |
| JP | 11103979 A | | 4/1999 | |

* cited by examiner

*Primary Examiner*—Teri Pham Luu
(74) *Attorney, Agent, or Firm*—Spencer K. Warnick; Hoffman, Warnick & D'Alessandro LLC

(57) ABSTRACT

A seat cushion including a first and second pillar positioned specifically for receiving the ischial tuberosities of a user. The pillars relieve the pressure of the ischial tuberosity areas, but are easy and inexpensive to manufacture. In addition, the position of the pillars can be customized for a particular user. Hence, pressure reduction is accomplished only where it is needed. The invention can be used on flat cushions and on cushions with a molded shape.

19 Claims, 2 Drawing Sheets

ISCHIAL TUBEROSITY PRESSURE RELIEF CUSHION

BACKGROUND OF THE INVENTION

1. Technical Field

The present invention relates generally to seat cushions, and more particularly, to a seat cushion adapted to relieve pressure of ischial tuberosities of a user.

2. Related Art

Seat cushions have been shaped and molded in a variety of ways to relieve pressure on users. In one example pressure-relief technique, pillars are employed throughout a cushion to relieve pressure. However, these devices are not adequately anatomically focused and therefore relieve pressure indiscriminately. To address this shortcoming, some devices provide different depth pillars for different regions of the body. However, these devices are relatively unfocused anatomically. In addition, these devices are expensive to manufacture because of the number of pillars required, many of which are unnecessary. The multiple pillar devices are also not optimal for all users. For example, a lighter user may not find the same comfort in a cushion designed for a heavier user.

Cushions that are generically contoured to a user's form have also found acceptance. These devices, however, do not provide adequate cushioning for interior areas of the body comprised of bony prominences. One interior area of the body that requires pressure relief to prevent reduced blood flow is the ischial tuberosity area of a user. The need for this type pressure relief extends to all types of seat cushions including vehicle seats, chairs, wheelchairs and so on.

In view of the foregoing, a need remains for seat cushion that does not suffer from the problems of the related art.

SUMMARY OF THE INVENTION

A seat cushion including a first and second pillar positioned specifically for receiving the ischial tuberosities of a user is provided. The pillars relieve the pressure of the ischial tuberosity areas, but are easy and inexpensive to manufacture. In addition, the position of the pillars can be customized for a particular user. Hence, pressure reduction is accomplished only where it is needed. In addition, the seat cushion provides focused pressure relief that is beneficial to those user's with less fleshy padding on their ischial tuberosities, but does not penalize those with extensive fleshy padding because they largely compress the cushion without engaging the pillars. In one embodiment, graduated slots are provided to create the pillars. The slots provide a transition from the greater pressure relief of the pillar to the lesser pressure relief of the intact cushioning member. The invention can be used on flat cushions and on cushions with a molded shape.

A first aspect of the invention includes a cushion consisting of: a cushioning member having a first pillar positioned for receiving a first ischial tuberosity of a user and a second pillar positioned for receiving a second ischial tuberosity of the user.

A second aspect of the invention is directed to a cushion consisting of: a cushioning member made of a foam; a first pillar positioned in the cushioning member for receiving a first ischial tuberosity of a user; and a second pillar positioned in the cushioning member for receiving a second ischial tuberosity of the user, wherein each pillar is formed from cuts formed in the foam that gradually recede to zero depth.

A third aspect of the invention provides a seat cushion comprising: a substantially planar cushioning member made of a polyurethane foam, the cushioning member including only: a first pillar formed in the cushioning member for receiving a first ischial tuberosity of a user, the first pillar having a polygonal cross-section and a graduated slot extending from each corner of the polygonal cross-section; and a second pillar positioned for receiving a second ischial tuberosity of the user, the second pillar having a polygonal cross-section and a graduated slot extending from each corner of the polygonal cross-section.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION OF THE INVENTION

Figure 1:
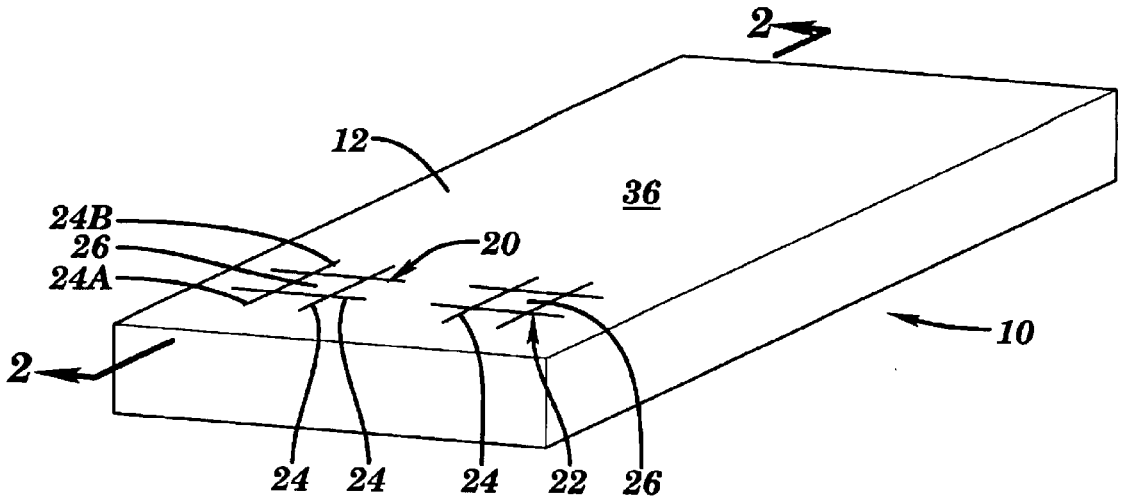
FIG. 1 shows a back perspective view of a seat cushion.

With reference to the accompanying drawings, FIG. 1 shows a perspective view of a seat cushion 10. Seat cushion 10 includes a cushioning member 12 that may be made of any now known or later developed material for making cushions. In one embodiment, medium density polyurethane foam is preferred. Cushioning member 12 may be formed as a substantially planar member or made to a specific form as known to those skilled in the art.

Cushion member 12 includes a pair of pillars 20, 22 and no other pillar-like structures. Each pillar 20, 22, however, also includes at least one graduated slot 24 extending therefrom. As used herein, a "graduated slot" shall refer to a cut or slit formation in cushioning member 12 that gradually recedes to a zero depth relative to a surface 36 of cushioning member 12. Each pillar 20, 22 is selectively positioned for receiving an ischial tuberosity of a particular user (not shown). That is, first pillar 20 is positioned for receiving a first ischial tuberosity of a user, and second pillar 22 positioned for receiving a second ischial tuberosity of the user. In one embodiment, the position of each pillar can be ascertained by reference to anthropometric tables of measurements that predict a fairly specific region wherein a user's ischial tuberosities will likely sit. In another embodiment, the distance between the ischial tuberosities of a particular user's may be measured and the pillars positioned that distance apart.

Figure 2:
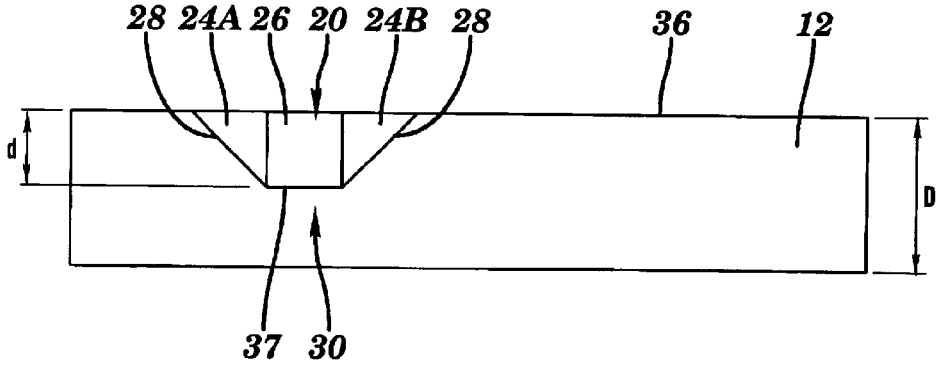
FIG. 2 shows a cross-sectional view along line 2—2 of FIG. 1.

Referring to FIG. 2, a cross section of a pillar 20 taken along line 2—2 of FIG. 1 is shown. As illustrated, graduated slots 24A, 24B extend from a main structure 26 of pillar 20. Pillars 20, 22 along with graduated slot(s) 24 selectively and progressively weaken cushioning member 12 resistance to compression under a user's ischial tuberosities. Each pillar 20, 22 and graduated slot(s) 24 may be formed by molding polyurethane foam to include the pillars and the slot(s). However, in one preferred embodiment, pillars 20, 22 and graduated slot(s) 24 are formed by making specific cuts in cushioning member 12, as will be described further below. In this fashion, no foam of cushioning member 12 is removed except for the thickness of the cutting device.

Figure 3A:
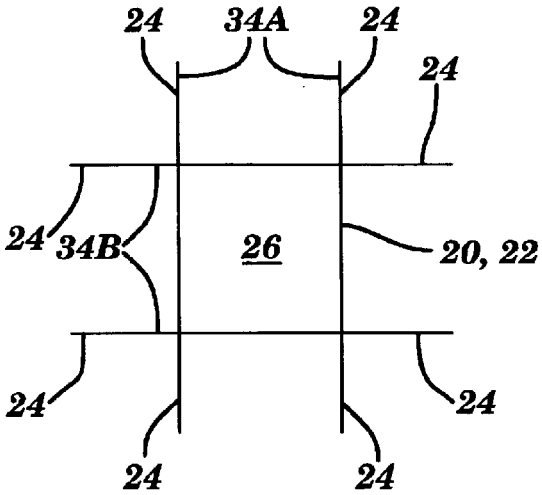
FIGS. 3A-D show various shaped pillars and graduated cuts for the seat cushion of FIG. 1.
Figure 3B:
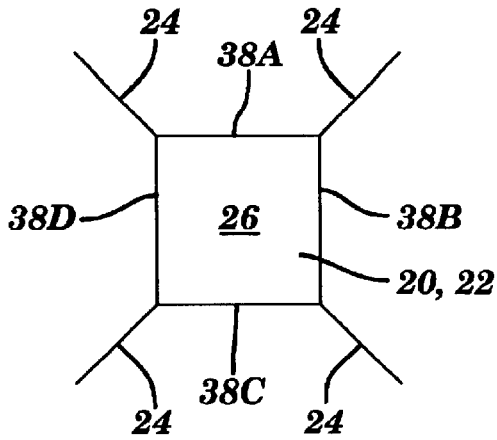
Figure 3C:
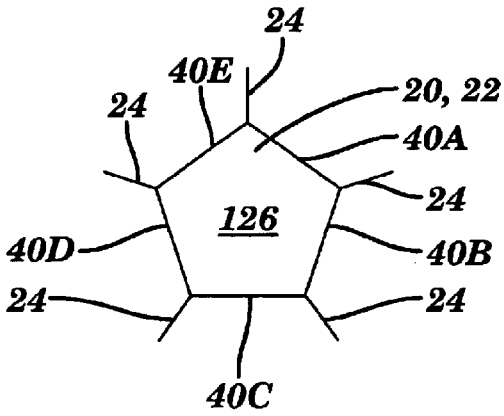

Referring to FIGS. 3A-D, cutting of cushioning member 12 in conjunction with illustrative cross-sectional shapes of the main structure of pillars 20, 22 will now be described. FIGS. 3A-3C illustrate polygonally cross-sectioned main structures 26, 126. FIG. 3A shows a square cross-sectioned main structure 26 that may be formed by a first set of parallel cuts 34A and a second set of parallel cuts 34B that substantially perpendicularly intersect the first set, i.e., the cuts form a tic-tac-toe form in a surface 36 (FIGS. 1 and 2) of cushioning member 12. In this case, the square cross-sectioned main structure 26 includes two graduated slots 24 extending from each corner. This pattern is the same as shown in FIGS. 1 and 2. Cutting can be provided by any of a number of devices suited for such purposes. For instance, cuts can be made by knife, hot wire, high speed grinding wheel, a blade or any other device adapted for cutting foam. The user can select the thickness of cut, e.g., minimal for knife and more for a blade. The cuts can be made by individual movements of a cutting device, a combination of movements, or as one movement depending on the shape and size of the cutting device. For instance, referring to FIGS. 2 and 3A, cuts 34A, 34B (FIG. 3A) can be made by a combination of four movements (one for each cut 34A, 34B) of a cutting device when the device can form a substantially trapezoidal shape 30 (FIG. 2) extending into cushioning member 12. Alternatively, four cuts 37 (FIG. 2) can be made to form square cross-sectioned main structure 26, and eight graduated cuts 28 can be made to form graduated slots 24. In another alternative, a cutting device can be structured, e.g., as a set of hot wires, to cut pillars 20, 22 in a single movement.

Figure 3D:
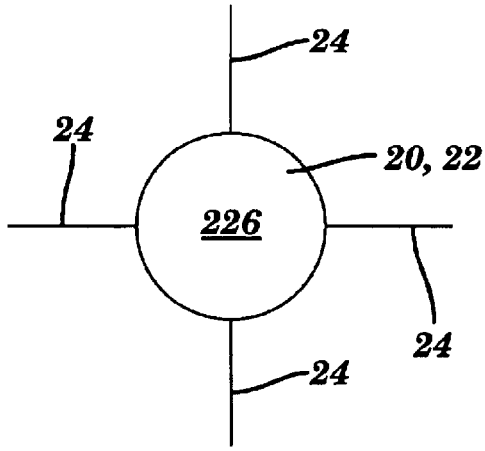

The following illustrative alternative cross-sectional shapes of the main structure of pillars 20, 22 can be formed by similar methods. FIG. 3B shows a square cross-sectioned main structure 26, and a graduated slot 24 extending from each corner. The pillar formation of FIG. 3B may be used to provide a less dramatic pressure relief compared to that of FIG. 3A. FIG. 3C shows a pentagonal cross-sectioned main structure 126 (formed by cuts 40A–E angled at approximately 72° to one another). In this case, each corner includes one graduated slot 24 extending therefrom. The pillar formation of FIG. 3C may be used to provide a pressure relief intermediate of those formations shown in FIGS. 3A and 3B. Polygons with a greater number of sides are also possible. These polygons provides more graduated slots which alters the character of the transition from pillar to non-pillared cushioning member. FIG. 3D shows a substantially circular cross-section main structure 226 and includes a number of equidistantly positioned graduated slots 24 (e.g., 4) extending radially from circular cross-section 226. While particular cross-sections for pillars 20, 22 have been illustrated and described, it should be recognized that the pillars may be any shape that adequately provides the progressive weakening of cushioning member 12.

Returning to FIG. 2, in any embodiment, cuts are preferably made such that a main structure 26 of pillar 20, 22 extends a distance 'd' approximately half the thickness 'D' of cushioning member 12. It should be recognized, however, that other depths are possible depending on a user's preference.

With regard to the graduated slots 24, while the attached drawings show the slots as straight lines, it should be recognized that the slots may be provided in any fashion desired. For example, graduate slots 24 may have curved form when they are cut with a revolving blade.

The above-described seat cushion 10 may be applied to any seat where the sitting position of a user is fairly well defined and limited. Illustrative applications include: motorcycle saddles, automotive seats, industrial and agricultural motorized vehicle seats, theater seats, office chairs, airliner passenger seats, etc.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A cushion consisting of:

a cushioning member having a first pillar positioned for receiving a first ischial tuberosity of a user, and a second pillar positioned for receiving a second ischial tuberosity of the user wherein each pillar includes at least one slot extending therefrom that gradually recedes to zero depth.

2. The cushion of claim 1, wherein each pillar has a polygonal cross-section.

3. The cushion of claim 2, wherein the polygonal cross-section is that of a square.

4. The cushion of claim 3, wherein the square is formed by a first set of parallel cuts and a second set of parallel cuts that substantially perpendicularly intersect the first set.

5. The cushion of claim 3, wherein the cushioning member includes a foam, and the at least one slot has a substantially trapezoidal shape extending into the foam.

6. The cushion of claim 3, wherein the square is formed by four substantially perpendicular cuts.

7. The cushion of claim 2, wherein each pillar further includes at least one graduated slot extending from each corner of the polygonal cross-section.

8. The cushion of claim 1, wherein each pillar has a substantially circular cross-section and includes at least four equidistantly positioned graduated slots extending radially from the circular cross-section.

9. The cushion of claim 1, wherein the cushioning member is made of a polyurethane foam.

10. The cushion of claim 1, wherein the first and second pillar extend approximately one half the thickness of the cushioning member.

11. A cushion consisting of:

a cushioning member made of a foam;

a first pillar positioned in the cushioning member for receiving a first ischial tuberosity of a user;

a second pillar positioned in the cushioning member for receiving a second ischial tuberosity of the user; and at least one slot extending from each pillar that gradually recedes to zero depth.

12. The cushion of claim 11, wherein each pillar has a polygonal cross-section.

13. The cushion of claim 12, wherein each pillar further includes at least one graduated slot extending from each corner of the polygonal cross-section.

14. The cushion of claim 11, wherein each pillar has a substantially circular cross-section and includes at least four equidistantly positioned graduated slots extending radially from the circular cross-section.

15. The cushion of claim 11, wherein the first and second pillar extend approximately one half the thickness of the cushioning member.

16. A seat cushion comprising:

a cushioning member made of a polyurethane foam, the cushioning member including:

a first pillar formed in the cushioning member for receiving a first ischial tuberosity of a user, the first pillar having a polygonal cross-section and at least one graduated slot extending from each corner of the polygonal cross-section and receding to a zero depth relative to a surface of the cushioning member; and a second pillar positioned for receiving a second ischial tuberosity of the user, the second pillar having a polygonal cross-section and at least one graduate slot extending from each corner of the polygonal cross-section and receding to a zero depth relative to a surface of the cushioning member.

17. The seat cushion of claim 16, wherein each pillar is cut into the cushioning member.

18. The seat cushion of claim 16, wherein each pillar is molded into the cushioning member.

19. The seat cushion of claim 16, wherein each pillar extends approximately one half the thickness of the cushioning member.

* * * * *